US005085533A

United States Patent [19]

Kitahara et al.

[11] Patent Number: 5,085,533

[45] Date of Patent: Feb. 4, 1992

[54] THERMAL PRINTER

[75] Inventors: Satoshi Kitahara, Mishima; Kazuaki Sugimoto, Numazu; Akio Yamamoto, Mishima; Ikuzo Sugiura, Sagamihara, all of Japan

[73] Assignee: Tokyo Electric Co., Ltd., Tokyo, Japan

[21] Appl. No.: 595,355

[22] Filed: Oct. 9, 1990

[30] Foreign Application Priority Data

Oct. 13, 1989 [JP] Japan ..... 1-265240

[51] Int. Cl.[5] ..... B41J 11/14

[52] U.S. Cl. ..... 400/652; 101/93.41; 400/120

[58] Field of Search ..... 400/120, 649, 552, 650, 400/652, 656, 657, 659, 153, 158, 158.1, 159; 101/93.41

[56] References Cited

U.S. PATENT DOCUMENTS

| | | | |
|---|---|---|---|
| 4,746,234 | 5/1988 | Harry | 400/120 |
| 4,828,408 | 5/1989 | Bekker-Madsen et al. | 400/120 |
| 4,848,941 | 7/1989 | Imaseki | 400/120 |
| 4,884,904 | 12/1989 | Berquist | 400/120 |

FOREIGN PATENT DOCUMENTS

| | | | |
|---|---|---|---|
| 0114975 | 11/1983 | European Pat. Off. . | |
| 3639967A1 | 11/1986 | Fed. Rep. of Germany . | |
| 39-62048 | 4/1964 | Japan . | |
| 102789 | 6/1983 | Japan | 400/649 |
| 13563 | 1/1985 | Japan | 400/656 |
| 120780 | 6/1986 | Japan | 400/691 |
| WO85/04840 | 4/1985 | PCT Int'l Appl. . | |

*Primary Examiner*—Edgar S. Burr
*Assistant Examiner*—Ren Yan
*Attorney, Agent, or Firm*—Frishauf, Holtz, Goodman & Woodward

[57] ABSTRACT

A thermal printer includes a support frame and a head frame supported by the support frame. A line thermal head is attached to the head frame. A platen unit is mounted on the support frame and includes a platen roller opposing the thermal head and a pair of support members supporting both ends of the platen roller. The support members are arranged to be rotatable so that the platen roller is movable between a contact position where the roller contacts the thermal head and a separate position where the roller is set apart from the thermal head. A pressing mechanism is provided on the platen unit so as to press the platen roller onto the thermal head at a predetermined pressure.

9 Claims, 7 Drawing Sheets

THERMAL PRINTER

BACKGROUND OF THE INVENTION

1. Field of the Invention

The present invention relates to a thermal printer and, more particularly to a thermal printer having a line thermal head, for performing direct-thermal printing (in which selected portions of heat-sensitive paper are heated by the thermal head, thereby to form characters on the heat-sensitive paper), or a heat-transfer thermal printing (in which selected portions of ink ribbon, which contact to a paper, are heated by the thermal head, thereby to transfer ink of the ribbon onto the paper).

2. Description of the Related Art

A bar-code printer is known which prints bar codes on labels. This printer comprises two side frame plates extending vertically and parallel to each other, a platen roller rotatably supported at both ends by the frame plates, a head frame rockably supported by the frame plates, and a line thermal head secured to the head frame. The bar-code printer further comprises a head-pressing mechanism provided on the frame plates, for pressing the line thermal head onto the platen roller. A sheet of paper can be passed between the line thermal head and the platen roller, so that the thermal head can print characters on the sheet.

Since the thermal head is spaced apart at one end, from the stationary paten roller, while the other end is contacting the platen roller, the printing pressure or contact pressure of the thermal head with respect to the platen roller is uneven in the longitudinal direction of the platen roller, inevitably deteriorating the printing quality. In the conventional thermal printer, to prevent application of an uneven printing pressure to the platen roller, the following measures are taken. The line thermal head has a projection protruding from its middle portion in the axial direction of the head. This projection is connected to the head frame by means of a pivot extending in a direction perpendicular to the axis of the line thermal head. The head is allowed to rotate freely around the pivot, only at its one end.

According to the conventional printer described above, however, the head frame must be large and massive because the head-pressing mechanism is mounted on the head frame. Thus, the bar-code printer will require a relatively large space in which to move the head frame along with the pressing mechanism, thereby making the printer to be large as a whole.

The bar-code printer can be used to provide either a direct-thermal printing or a heat-transfer thermal printing. When it is used for a direct-thermal printing, no ink-ribbon supply device is mounted on the head frame. When it is used for a heat-transfer thermal printing, an ink-ribbon supply device is mounted on the head frame. Apparently, the printing pressure the head applies to recording paper when no ink-ribbon supply device is placed on the head frame is different from the printing pressure the head exerts on recording paper when an ink-ribbon supply device is mounted on the head frame. Needless to say, such a difference in the printing pressure applied to the paper results in a difference in the quality of the bar codes printed by the bar-code printer on the paper.

SUMMARY OF THE INVENTION

It is accordingly the object of this invention to provide a thermal printer which can accomplish a high-quality printing.

According to the invention, to achieve the above object, there is provided a thermal printer comprising: a support body; a head frame supported by the support body; a line thermal head attached to the head frame, for printing data on a recording medium; a platen unit having a platen opposing the line thermal head, and support means for supporting the platen and allowing said platen to move between a contact position where the platen contacts the line thermal head and a separate position where the platen is set apart from the line thermal head; and pressing means for pressing the platen onto the line thermal head so as to apply a predetermined printing pressure to the line thermal head.

With the printer having the above arrangement, the thermal head attached to the head frame is arranged stationary and immovably. In contrast, the platen is movable with respect to the line thermal head, and is pressed onto the head by the pressing means. Thus, the thermal head does not move at all even when an ink-ribbon supply device or the like is mounted on the head frame. Hence, the pressing means always presses the platen onto the line thermal head, with a constant pressure. The line thermal head can, thus, print high-quality characters on the paper wrapped around the platen.

It is preferable that the supporting means of the platen unit has a pair of support members supporting the ends of the platen, respectively. These supports members can move independently of each other, so that the platen can incline to remain parallel to the line thermal head as long as it is pressed onto the head by the pressing means. In other words, the platen does not contacts the head at one end, while spaced apart therefrom at the other end. This also helps to perform high-quality printing.

Moreover, it is preferable that the head frame is supported by the support body to be movable from an operating position where the thermal head can contact the platen to a non-operating position where the thermal head is spaced apart from the platen. This facilitates the setting a recording medium in the printer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 8 show a thermal printer according to an embodiment of the present invention, in which:

FIG. 1 is a perspective view showing an outline of the printer;

FIG. 2 is a front view of the printer, with its front cover removed;

FIG. 3 is a sectional view of the printer, taken along line III—III in FIG. 2;

FIG. 4 is a sectional view of the printer, taken along line IV—IV in FIG. 2;

FIG. 5 is an enlarged perspective view showing a thermal head and a platen unit of the thermal printer;

FIG. 6 is a perspective view showing a head frame of the thermal printer;

FIG. 7 is a sectional view, taken along line VII—VII in FIG. 2; and

FIG. 8 is a sectional view, taken along line VIII—VIII in FIG. 2.

DETAILED DESCRIPTION OF THE PREFERRED EMBODIMENTS

A thermal printer according to an embodiment of the invention will now be described, with reference to the accompanying drawings.

Figure 1:
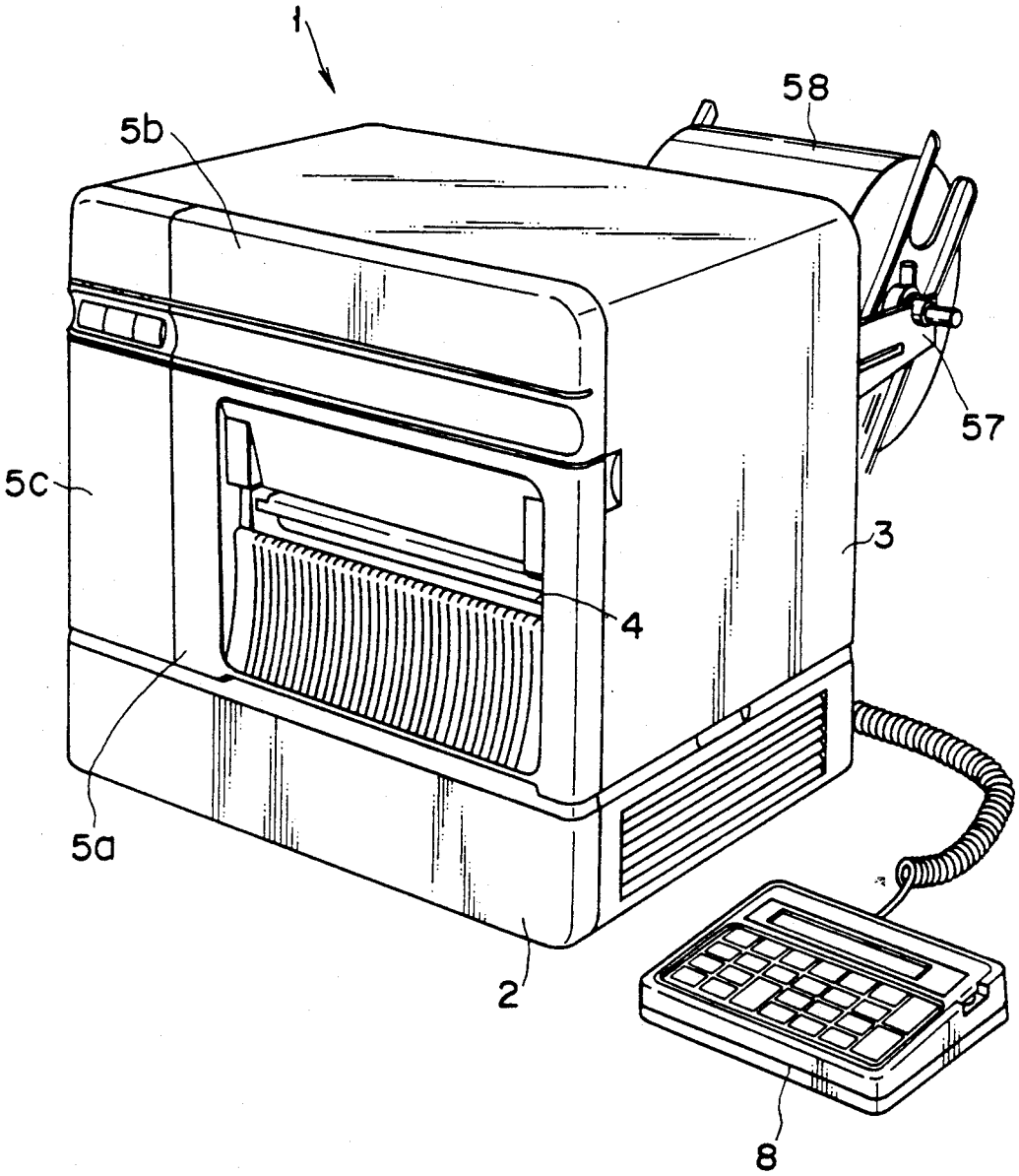
Figure 2:
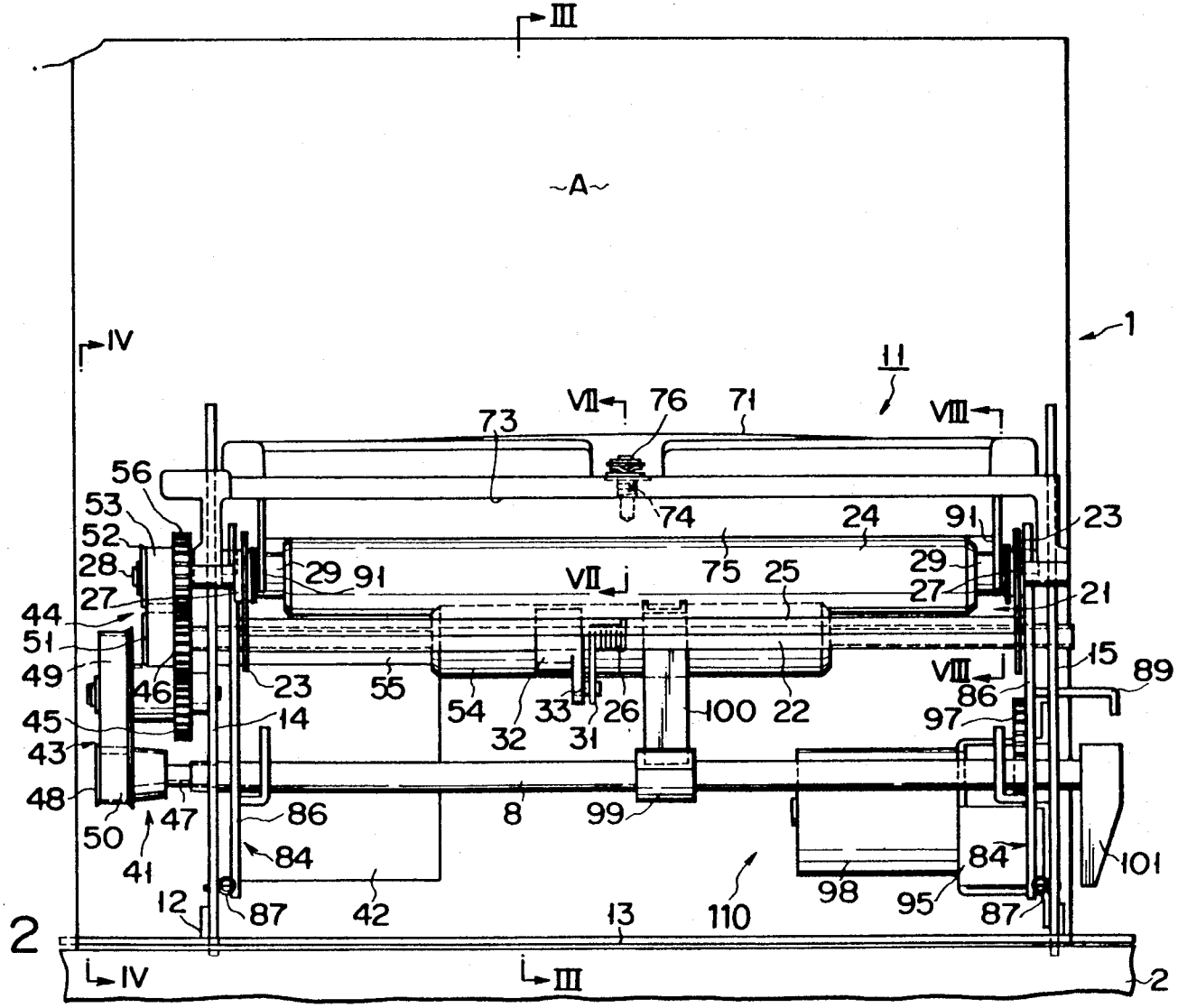
Figure 3:
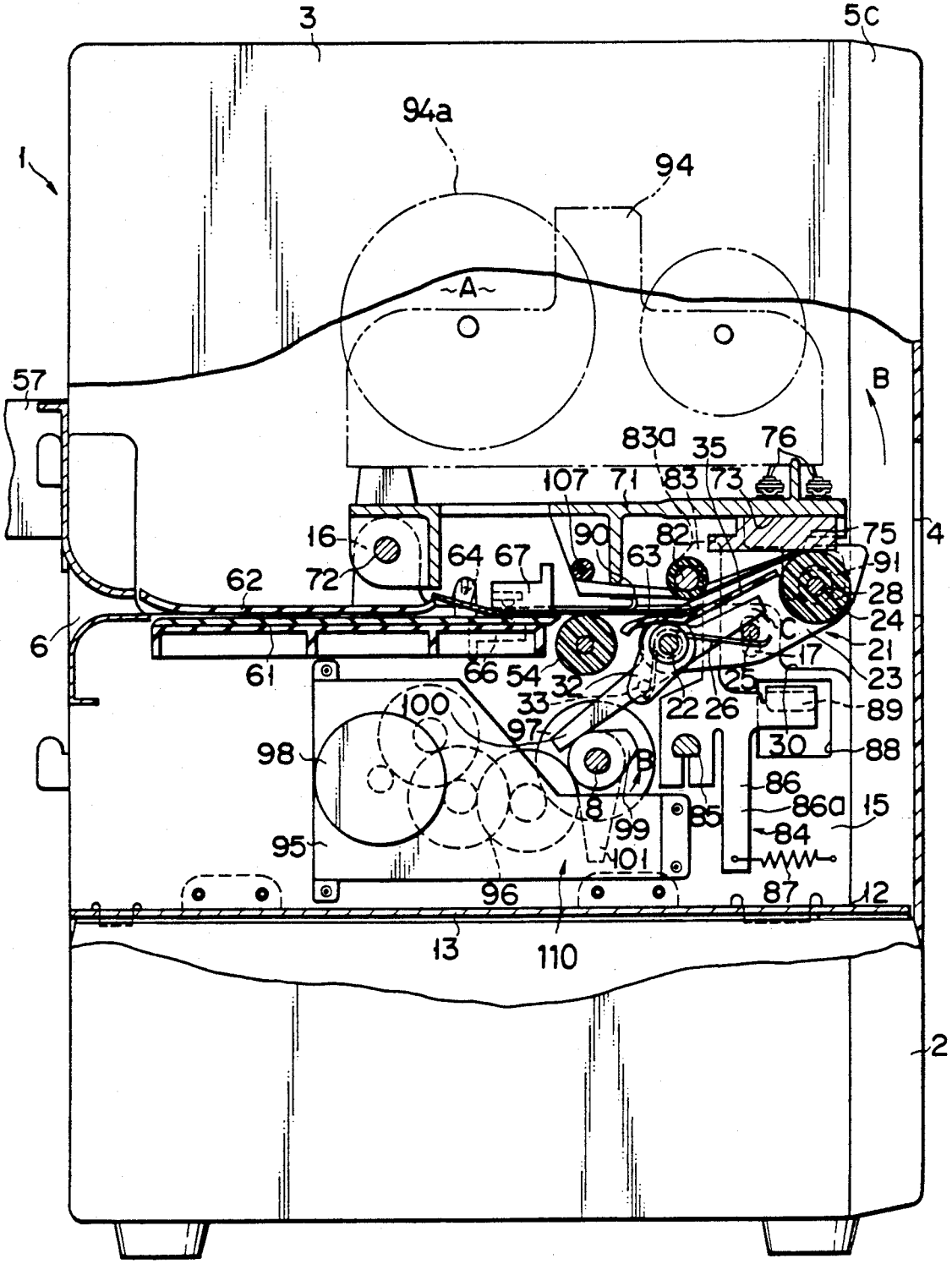

As is shown in FIGS. 1 to 3, the thermal printer comprises a case 1. The case 1 is comprised of a rectangular base 2, a side panel 3, a first front panel 5*a*, a second front panel 5*b*, and a third front panel 5*c*. The side panel 3 is removably mounted on the base 2. It consists of a pair of side walls and a top wall connected to the upper ends of the side walls, and thus has an U-shaped cross section. The first front panel 5*a* has an L-shaped cross section and has an elongated opening 4 through which sheets of paper can pass. The second front panel 5*b* is integrally formed with the side pane 3 and contacts the upper side of the first front panel 5*a*. The third front panel 5*c* is secured to the base 2 and contacts the left sides of the first and second front panels 5*a* and 5*b*. A controller 8 is connected to the thermal printer. The controller 8 has a ten-key pad, which an operator operates to input data to be printed by the thermal printer.

The case 1 contains a printing mechanism 11. This mechanism will be descried in detail with reference to FIGS. 2 to 4.

Figure 4:
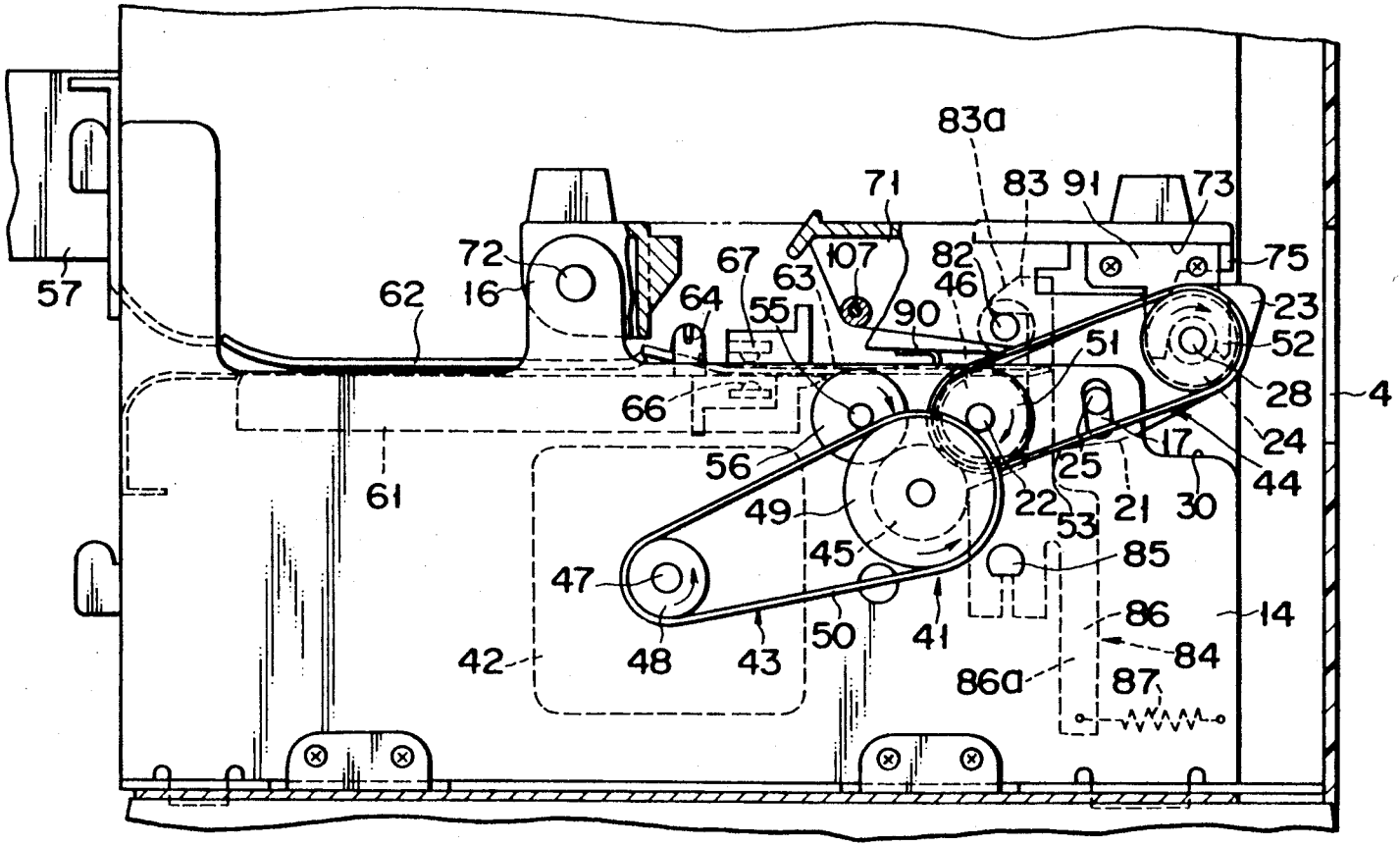

As FIG. 2 to 4 show, the printing mechanism 11 comprises a frame 12 serving as a support body. The frame 12 is formed of a flat bottom plate 13 secured onto the upper surface of the base 2 of the case 1, and two side plates 14 and 15 connected by the bottom plate 13, extend upward, and opposing each other. Two supporting projections 16 protrude upward from the upper-middle portions of the side plates 14 and 15, respectively, and oppose each other. The side plates 14 and 15 have each an elongated guide hole 17 bored in the upper portion, located in front of the projection 16, and extending vertically. These guide holes 17 also oppose each other.

The printing mechanism 11 has a platen unit 21. The unit 21 is arranged between the side plates 14 and 15, and rotatably supported thereby. The platen unit 21 comprises a support shaft 22, two support plates 23, a platen roller 24, an intermediate shaft 25, and a pressure-exerting spring 26 serving as pressing means.

More precisely, as is illustrated in FIGS. 2 to 5, the support shaft 22 is substantially horizontal and extends between the side plates 14 and 15. It is fixed at both ends to the plates 14 and 15, and it cannot rotate. The support plates 23, which are parallel to each other, are flat and located beside the side plates 14 and 15, respectively. They have through holes made in their end portions. The support shaft 22 extends through these holes, so that both support plates 23 can independently rotate around the shaft 22.

A bearing 27 having a through hole is attached to the front end portion of either support plate 23. The shaft 28 of the platen roller 24 have its axial end portions extending through the holes of the bearings Hence, the platen roller 24 extends substantially horizontally between the support plates 23. The platen shaft 28 has two large-diameter portions 29 which protrude from the ends of the platen roller 24, respectively.

The side walls 14 and 15 of the frame 12 have a U-shaped cutout 30 each, which is made in the front end portion. The U-shaped cutouts 30 prevent the platen shaft 28, which is, like support shaft 22, is longer than the distance between the side plates 14 and 15, from interfering with the side plates 14 and 15 of the frame 12.

The intermediate shaft 25 is located between the support shaft 22 and the platen roller 24, and extends horizontally between the side plates 14 and 1 of the frame 12. Both end portions of the shaft 25 extend passing through the support plates 2 to be rotatable relative to the plates 23, and are slidably inserted into the guide holes 17 of the side plates 14 and 15, respectively.

When the ends of the intermediate shaft 25 slide in the corresponding guide holes 17, both support plates 23 can rotate independently of each other, around the support shaft 22 by an angle corresponding to the distance for which the ends of the shaft 25 move. As the support plates 23 rotate, the platen roller 24 is moved between a contact position where it contacts a line thermal head 75 (descried later) and a separate position where it is spaced apart from the head 75.

The pressure-exerting spring 26 is, for example, a torsion spring wound around the middle portion of the support shaft 22. One end 31 of the spring 26, to which a force is applied, is hooked onto a pin 33 of a spring seat 32 which is fastened to the support shaft 22. The other end of the spring 26, which exerts a pressure on the platen roller 24, is hooked onto the middle portion of the intermediate shaft 25, more precisely at the position exactly half way between the support plates 23. Hence, the spring 26 exerts a pressure to the platen roller 24 through the intermediate shaft 25 and the support plates 23, biasing the platen roller 24 upward or toward the line thermal head 75.

As is shown in FIG. 3, the printing mechanism 11 has a final paper guide 35 for guiding a recording paper to the printing section or between the platen roller 24 and the line thermal head 75. The paper guide 35 is located above the platen unit 21 so that it prevents neither support plates 23 from moving.

As is illustrated in FIG. 2, a paper-feeding mechanism 41 is attached to the left side plate 14. As is evident from FIGS. 2 and 4, the paper-feeding mechanism 41 comprises an electric motor 42, a first belt-pulley transmission 43, a second belt-pulley transmission 44, a first transmission gear 45, and a second transmission gear 46.

The electric motor 42 is a stepping motor. It is secured to the inner surface of the side plate 14. Its drive shaft 47 passes through the plate 14 and protrudes outwards therefrom. The first belt-pulley transmission 43 is comprised of a pulley 48 fixed to the shaft 47 of the motor 42, a pulley 49 rotatably attached to the side plate 14, and an endless belt 50 wrapped around the pulleys 48 and 49. The second belt-pulley transmission 44 is comprised of a pulley 51 rotatably mounted o the left end of the support shaft 22 (FIG. 2), a pulley 52 fixed on the left end of the platen shaft 28 (FIG. 2), and an endless belt 53 wrapped around the pulleys 51 and 52. The pulley 49 is made of synthetic resin, and the first transmission gear 45 is integrally formed with this pulley 49. Similarly, the pulley 51 is made of synthetic resin, and the second transmission gear 46 is integrally formed with the pulley 51. The transmission gears 45 and 46 are meshed with each other.

When the drive shaft 47 of the electric motor 42 rotates counterclockwise (in FIG. 4), it drives the belt 50 of the first belt-pulley transmission 43 in the same direction, thus rotating the first transmission gear 45 in the same direction. The second transmission gear 46, in mesh with the gear 45, is therefore rotated clockwise as is shown in FIG. 4, driving the belt 53 of the second belt-pulley transmission 44 in the same direction. As a result, the pulley 52 is rotated clockwise, thereby rotating the platen roller 24 also clockwise as is shown in FIG. 4. As the platen roller 24 rotates so it feeds a sheet of paper forward.

A paper-feeding roller 54 extends horizontally between the side plates 14 and 15 and is located close the rear portion of the platen unit 21. The shaft 55 of the roller 54 is rotatably supported at both ends by the side plates 14 and 15, respectively. A gear 56 is fixed to that end portion of the roller shaft 55 supported by the side plate 14. This gear 56 is in mesh with the first transmission gear 45. Hence, as the shaft of the electric motor 42 rotates counterclockwise (in FIG. 4), the paper-feeding roller 54 is rotated clockwise (in FIG. 4).

As is illustrated in FIGS. 3 and 4, an inlet paper guide 61 is arranged at the rear of the paper-feeding roller 54 and extends almost horizontally between the side plates 14 and 15. A paper guide 62 is located above the guide 61 and spaced apart therefrom. The paper guide 62 can be expanded or contracted in the direction parallel to the axis of the paper-feeding roller 54, so that its width can be adjusted to that of the sheets of paper used. Further, an intermediate paper guide 63 is arranged above the paper-feeding roller 54, with its rear end located continuous to the front end of the paper guide 62, its front end located above the rear end portion of the final paper guide 35, and its middle portion set in contact with the paper-feeding roller 54. The rear end portion of the guide 63 is hinged to a support rod 64. Hence, the guide 63 can rotate around the axis of this support rod 64. The intermediate paper guide 63 is made of a metal plate.

As is shown in FIGS. 1 and 3, a roll holder 57 is attached to the rear wall of the case 1. The roll holder 57 holds a roll 58 of heat-sensitive paper as a recording medium. The heat-sensitive paper fed out of the roll 58 is guided into the case 1 through an inlet slit 6 formed in the rear wall of the case. Within the case 1, it passes through the gap between the guides 61 and 62 and is guided between the paper-feeding roller 54 and the intermediate paper guide 63. As the roller 54 is rotated clockwise (in FIG. 4), the heat-sensitive paper is fed to the printing section, while being guided by the final paper guide 35.

As is shown in both FIG. 3 and FIG. 4, a light-emitting device 66 having a light-emitting diode (not shown) is located on the front end portion of the inlet paper guide 61, and a light-receiving device 67 having a photosensor (not shown) is mounted on the intermediate paper guide 63 to oppose the device 66. Hence, the devices 66 and 67 cooperate to detect the heat-sensitive paper passing between them.

Figure 7:
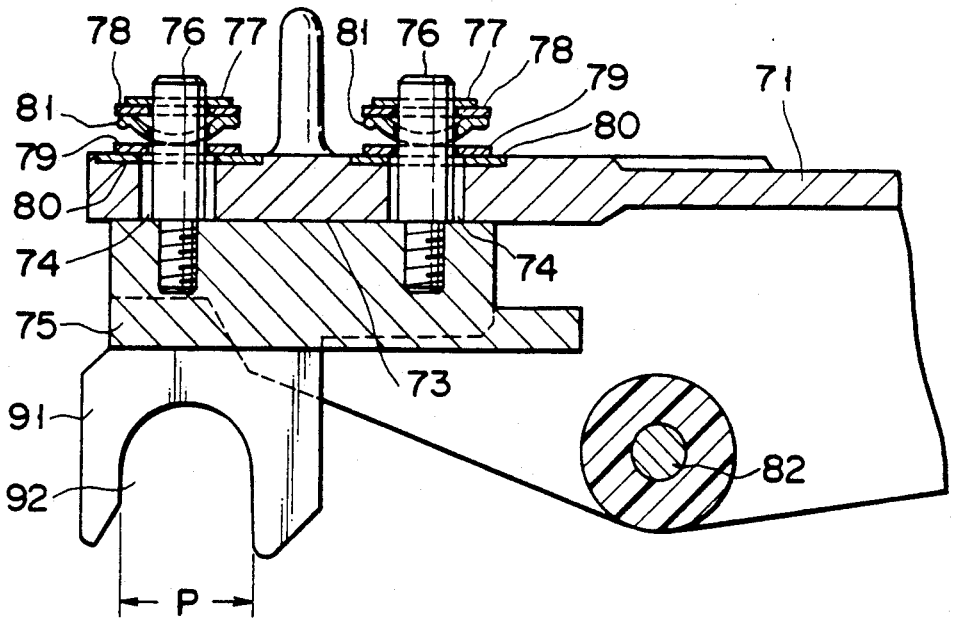

A head frame 71 is arranged above the platen unit 21. As is shown in FIG. 7, the frame 71 is a rectangular plate having both edges bent at right angle. Through hole are bored in the rear end portion of the frame 71. An axle 72 passes through the holes of the frame 71 and fastened at both ends to the projections 16 protruding from the side plates 14 and 15. Thus, the head frame 71 is supported by the axle 72 to be rotatable around it in the direction of an arrow B from a horizontal operating position illustrated in FIG. 3. As is shown in FIGS. 3 and 4, U-shaped leaf springs 90 are fastened to the lower surface of the head frame 71. As long as the frame 71 takes the operating position, the leaf springs 90 keep biasing the intermediate paper guide 63 downwards, pressing the guide 63 onto the paper-feeding roller 54.

Figure 6:
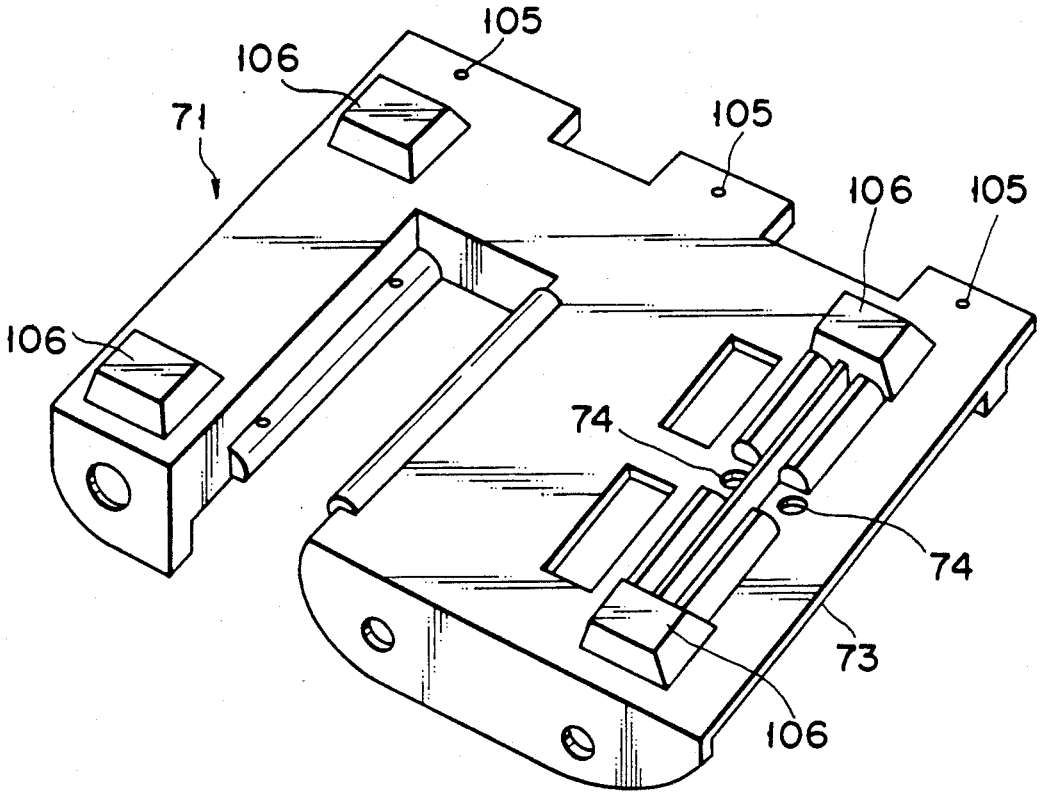

As is shown in FIGS. 6 and 7, the lower surface of the front portion of the head frame 71 constitutes a flat head mounting surface 73. The front portion of the frame 71 also has two through holes 74 open to the mounting surface 73. The holes 74 are set apart from each other in the axis of the head frame 71, and are located at the center in the axial direction of the platen roller 24. The through holes 74 are elongated in the axial direction of the head frame 71. Nonetheless, they can be round holes or elliptical holes.

The line thermal head 75 is attached to the flat mounting surface 73 of the head frame 71. The head 75 is thin and rectangular, and arranged so that its longitudinal axis extends parallel to the axis of the platen roller 24. While the head frame 71 is held in the operating position (FIG. 3), the line thermal head 75 contacts the platen roller 24. When the frame 71 is rotated in the direction of the arrow B (FIG. 3), the head 75 is moved away from the platen roller 24.

Figure 5:
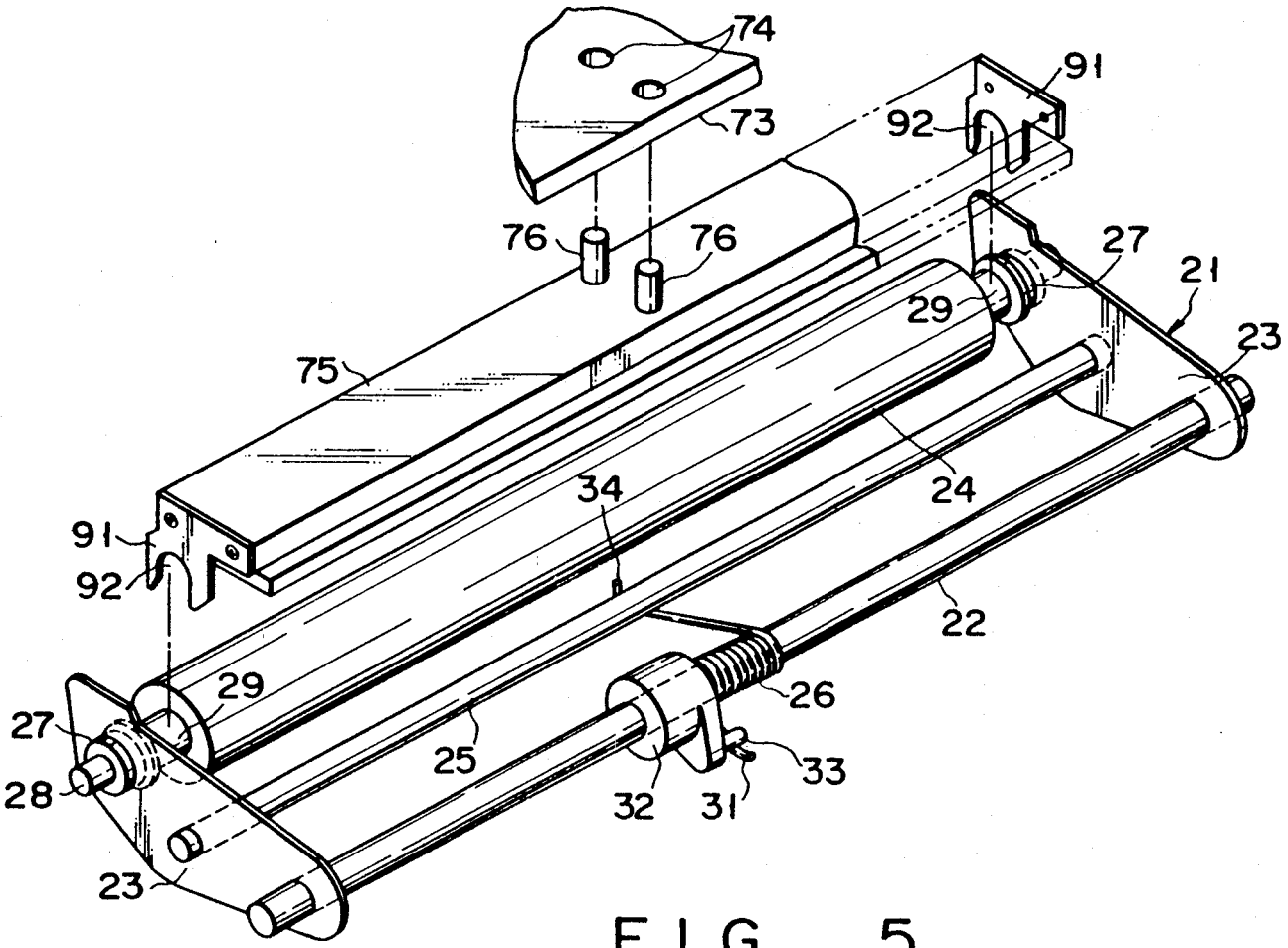

The line thermal head 75 can move a little horizontally with respect to the head frame 71, while held in contact with the mounting surface 73 of the frame 71. Specifically, as shown in FIGS. 5 and 7, the thermal head 75 is provided at its central portion with two connecting pins 76, which project upward therefrom and pass through the holes 74 of the head frame. The pins 76 have a diameter less than that of the holes 74, and thus, the thermal head 75 can move with respect to the frame 71 for a distance equal to the clearance between either pin 76 and the edge of the through hole 7 in which the pin 76 is loosely inserted. Either connecting pin 76 has its lower end set in screw engagement with the head 75 and its upper end protruding from the upper surface of the head frame 71. A stop ring 77 is fastened to the top of the pin 76. Three flat washers 8, 79 and 80 and one waved washer 81 are loosely fitted on the pin 76 and located between the upper surface of the frame 71 and the stop ring 77, such that the wave washer 81 is interposed between the flat washers 78 and 79.

By virtue of its spring force the waved washer 81 pushes the washer 78 onto the stop ring 77 and the washers 79 and 80 onto the upper surface of the frame 71, thereby holding the head 75 in contact with the flat mounting surface of the frame 71. The wave washers 81 can be replaced by any other biasing member.

Figure 8:
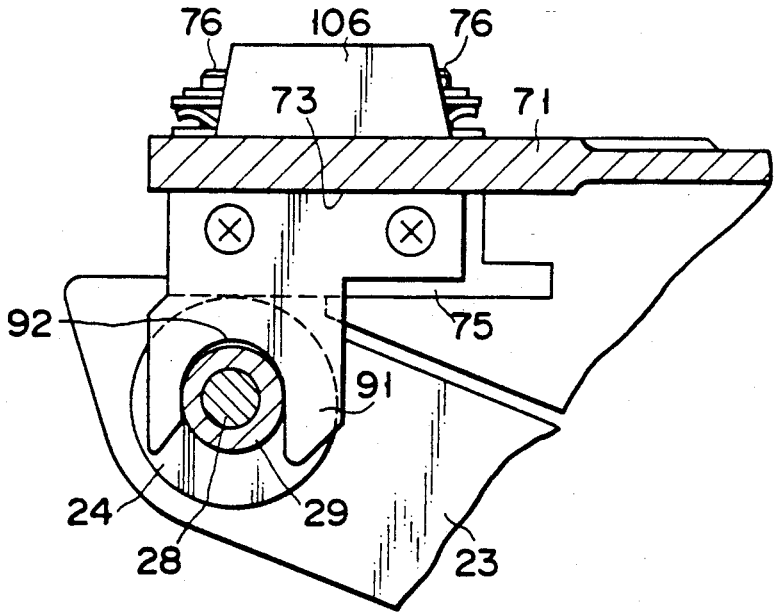

As is illustrated in FIGS. 5, 7 and 8, two U-shaped positioning plates 91 ar fastened to the axial ends of the head 75, respectively, by means of screws. These plates 91 extends downwards, and have a U-notch 92 each. The U-notch 92 slightly diverges downwards, so that the large-diameter portion 29 of the platen shaft 28 may easily be fitted into the notch 92. The width P of either U-notch 92 is substantially the same as the diameter of the large-diameter portion 29 of the platen shaft 28.

As is indicated by the two-dot, one-dash lines in FIG. 3, a ribbon supply device 94 can be mounted on the top of the head frame 71 and be accommodated in a space A provided within the case 1, right above the printing mechanism 11. The device 94 contains a roll of an ink ribbon 94*a* and a take-up reel. As is evident from FIGS. 3 and 6, the head frame 71 has three screw holes 105, four mounts 106, and two ribbon-guiding shafts 82 and 107. The screw holes 105 are used to fasten the ribbon supply device 94 to the head frame 71. The mounts 106 are provided to support the device 94. The shafts 82 and 107 are used to guide the running of the ink ribbon 94*a*.

When the ribbon supply device 94 is attached to the head frame 71, the thermal printer functions as a heat-transfer thermal printer. In this case, the ink ribbon fed from the roll is guided between the platen roller 2 and the line thermal head 75, whereas a sheet of paper, used as a recording medium, is fed though the gap between the ink ribbon and the platen roller 24.

The head frame 71 constructed as mentioned above is held at the operating position by means of a frame-holding mechanism 84, which will be described later. As long as the frame 71 is held in the operating position, the line thermal head 75 is kept at a printing position where it is in contact with the platen roller 24.

To be more specific, as is shown in FIGS. 2 and 3, the ribbon-guiding shaft 82 of the head frame 71 extends between, and parallel to, the axle 72 and the head 75. The shaft 82 has two axial ends constituting engagement portions described later. The frame-holding mechanism 84 also has a pair of claws 83 which are detachably hooked to the engagement portions of the shaft 82, whereby the mechanism 84 holds the ribbon-guiding shaft 82. The mechanism 84 further comprises a rotary shaft 85, a pair of hooks 86, and a pair of coil springs 87. The shaft 85 extends parallel to the ribbon-guiding shaft 82, and is rotatably supported, at both ends, by the side plates 14 and 15. The hooks 86 are fixed to the shaft 85 and located adjacent to the side plates 14 and 15, respectively. Hence, they rotate when the shaft 85 rotates. Either hook 86 has a projection which extends upward from the shaft 85 and has the claw 83 at the tip. It also has an arm 86*a* which extends downwards, and the coil spring 87 or compression spring is 20 stretched between the arm 86*a* and the side plate (14 or 15). Thus, the hook 86 is biased to rotate counterclockwise (in FIG. 3), by means of the coil spring 87. Hence, the claw 83 is set in engagement with the engagement portion of the ribbon-guiding shaft 82, whereby the head frame 71 is locked in the operating position.

Either claw 83 of the hooks 86 has a slope 83*a* on which the ribbon-guiding shaft 82 slides when the head frame 71 is rotated downward from its non-operating position to the operating position. Hence, when the frame 71 is rotated downward to the operating position, the shaft 82 rotates the hook 86 clockwise against the biasing force of the coil spring 87. When the head frame 71 reaches the operating position, the coil spring 87 rotates the hook 86 counterclockwise, whereby the claw 83 automatically goes into engagement with the engagement portion of the ribbon-guiding shaft 82. As a result of this, the head frame 71 is locked in the operating position. At this time, the claws 83 keep into engagement with the engagement portions of the shaft 82 by virtue of only the force of the coil spring 87, but also the force of the pressure-exerting spring 26 which has been transmitted to the head frame 71 through the platen roller 24 and the line thermal head 75. In other words, both springs 26 and 87 serve to lock the head frame 71 in the operating position. The bias of the spring 26 is greater than the total weight of the frame 71 and the ribbon supply device 94.

When an excessive load is applied downward on the head frame 71 after the frame 71 has been set in the operating position, the front-lower edge of the frame 71 abuts on both side plates 14 and 15. The head frame 1 is thereby prevented from further moving downwards.

As is shown in FIG. 3, the right side plates 15 has a through hole 88. The hook 86, which opposes the side plate 15, has a release lever 89 a portion of which is bent. The lever 89 passes through the hole 88 of the side plate 15 and protrudes outwardly. As the release lever 89 contacts the circumference of the through hole 88, the rotation of both hooks 86 is restricted. The release lever 89 is exposed when the side panel 3 is removed from the case 1, so that an operator can have an access to the lever 89. When the operator rotates the release lever 89 downward or clockwise (in FIG. 3), both claws 83 of the frame-holding mechanism 84 are released from the ends of the ribbon-guiding shaft 82. As result, the head frame 71 is unlocked and allowed to rotate upward from the operating position.

As is illustrated in FIGS. 2 and 3, the thermal printer further comprises a platen-moving mechanism 110 designed to move the platen roller 24 away from the line thermal head 75, so that a recording paper can be fed faster than otherwise. This mechanism 110 comprises a gear box 95 fastened to the side plate 15 and containing a reduction gear mechanism 96. The mechanism 96 has a plurality of gears. Of these gears, the output gear 97 is fastened to a shaft 8. The shaft 8 extends parallel to the support shaft 22 and the shaft 85 and is rotatably supported at both ends by the side plates 14 and 15. In the gear box 95 is contained a drive motor 98 or a pulse motor.

A cam 99 is mounted on the middle portion of the shaft 8. A cam follower 100, shaped like a lever, is rotatably mounted on the middle portion of the shaft 22 of the platen unit 21. The rear end portion of the cam follower 100 rests upon the cam 99. The front end portion of the cam follower 100 rests on the intermediate shaft 25. The right end portion of the shaft 8 passes through a hole made in the side plate 15 and extends outwards therefrom. An operation lever 101 is coupled to the right end of the shaft 8.

The platen-moving mechanism 110 is operated to feed the recording paper fast in the case where no data needs to be printed in a relatively large portion of the paper. The mechanism 110 is operated in the manner described below.

First, the stepping motor 98 is driven, thus rotating the shaft 8 and, hence, the cam 99, both in the direction of the arrow B in FIG. 3. The cam follower 100 is thereby rotated in the direction of an arrow C (FIG. 3) around the support shaft 22. The cam follower 100 pushes the intermediate shaft 25 downwards, whereby both support plates 23 also rotate in the direction of the arrow C around the shaft 22 or move down. As a result, the platen roller 24 is moved down, away from the line thermal head 75. The gap between the roller 24 and the head 75 increases, whereby the recording paper can be fed faster. The gap between the roller 24 and the head 75 can be increased to feed the paper faster, also by rotating the operation lever 101, thereby rotating the shaft 8 in the direction of the arrow B (FIG. 3).

In the case where the ribbon supply device is use for performing the transfer thermal printing, it is not only when there is no need to print data on a large portion of the paper, but also when the paper is fed for a one-line distance, that the stepper motor 98 is driven, thus moving the platen roller 24 away from the head 75 to feed the paper faster. While the paper is fed for the one-line distance, and the platen roller 24 thus remains spaced apart from the head 75, the ink ribbon is not fed at all. Hence, the ribbon is not wasted.

Upon the printing by means of the thermal printer having the construction described above, first, the paper fed from the roll 58 held in the holder 57 is set in the printing mechanism 11, and then the head frame 71 is rotated to the operating position. At the same time, the claws 83 of the frame-holding mechanism 84 go into engagement with the ends of the ribbon-guiding shaft 82, whereby the head frame 71 is locked at the operating position.

Meanwhile, the platen roller 24 of the paten unit 21, which is located below the head frame 7, is biased upwardly toward its contact position because of the pressure exerted via the intermediate shaft 25 and the support plates 23 from the pressure-exerting spring 26 attached to the support shaft 22. Therefore, once the head frame 71 is locked at the operating position, the platen roller 24 is pushed from under, onto the line thermal head 75 fastened to the head frame 71. Thus, an appropriate printing pressure is applied to the head 75 as long as the platen roller 24 contacts the head 75. While the platen roller 24 is contacting the head 75, the large-diameter portions 29 of its shaft 28 is fitted in the U-notches 92 of the positioning plates 91. The platen roller 24 is thereby so positioned that its axis is placed in the plane containing the axis of the line thermal head 75.

The paper (i.e., heat-sensitive paper) is pinched between the platen roller 24 and the line thermal head 75 which contact with each other in the manner described above. Hence, the head 75 can print data on the paper when it is energized.

As has been described, according to the thermal printer, during the printing operation, the head frame 71, to which the line thermal head 75 is attached, is locked in the operating position, and the platen unit 21 having the platen roller 24 is movable relative to the thermal head 75. Further, the pressure-exerting mechanism for applying a predetermined printing pressure to the thermal head 75 is provided on the platen unit 21. The head frame 71 is, therefore more compact than its counterpart used in the conventional thermal printer, which is arranged to be movable and incorporates a pressure-exerting mechanism. Thus, the head frame 71 does not occupy a large space even when a ribbon supply device is mounted on it.

Since the head frame 71 is locked and immovable during the printing operation, the weight of the ribbon supply device mounted on the frame 71 imposes no influence on the printing pressure. Whether the thermal printer is used for a direct-thermal printing or a heat-transfer printing, a constant printing pressure can be applied to the thermal head.

The support plates 23 of the platen unit 21 ca rotate around the support shaft 22, independently of each other. In accordance with the rotation of the support plates 23, the both axial ends of the platen roller 24 can move relative to the thermal head 75, independently of each other. Therefore, even if the platen roller 24 is positioned not parallel to the line thermal head 75 due to the difference in size between the components of the platen unit 21, the position of the platen roller 24 can be automatically adjusted, merely by rotating one or both of the support plates 23 properly.

In addition, the force of the pressure-exerting spring 26 is uniformly distributed to the support plates 23 through the intermediate shaft 25 and the support plates 23. This is because no other spring than the spring 26 is used to exert pressure to the head 75, and also because the end portion of the spring 26 is hooked to the middle portion of the support shaft 22. The uniform distribution of the force of the spring 26 to the support plates 23 helps to make the platen roller 24 applies an uniform pressure to the line thermal head 75.

Moreover, the support plates 23 can rotate independently of each other around the support shaft 22 despite the fact that the intermediate shaft 25 horizontally extends between the support plates 23. This is because the intermediate shaft 25 is rotatably supported by the support plates 23.

As has been described, the line thermal head 75 is attached to the flat mounting surface 73 of the head frame 71 by means of the connecting pins 76, but the pins 76 are loosely inserted in the through holes 74 made in the frame 71. Hence, the head 75 can slightly move in the plane parallel to the mounting surface 73. Actually, the head 75 is moved a little horizontally and is automatically positioned parallel to the platen roller 24 when the ends of the large diameter portions 29 of the platen shaft are fitted in the U-notches 92 of the positioning plates 91 fastened to the ends of the head 75. Thus, the entire printing surface of the head 75 uniformly contacts the platen roller 24, whereby the roller 24 exerts a uniform pressure to the head 75. This prevents generation of miss-printing or uneven printing, thereby achieving high-quality printing.

Since the platen roller 24 and the line thermal head 75 are automatically positioned parallel to each other, a serviceman need not adjust the position of the new head 75, which he or she has just replaced with the old one. What the serviceman should do to replace the head 75 with a new one is only to remove the head 75 from the frame 71 and attach the new one thereto.

The present invention is not limited to the embodiment described above. Various changes and modification can be made within the scope of the present invention. For example, the intermediate shaft 25 can be dispensed with, in which case a pair of pressure-exerting springs are used to bias the support plates 23, respectively. Also, only one connecting pin can be used, and only one through hole can be made in the head frame 71, instead of two pins 76 and two through holes 74 as is best illustrated in FIG. 7. Further, connecting pins 76 can have their lower ends put in screw engagement with the end portions of the head 75, not with the middle portion thereof. If this is the case, the through holes 74 are formed in the frame 71, at such positions as to allow the passage of these connecting pins 76.

Additional advantages and modifications will readily occur to those skilled in the art. Therefore, the invention in its broader aspects is not limited to the specific details, and representative devices, shown and described herein. Accordingly, various modifications may be made without departing from the spirit o scope of the general inventive concept as defined by the appended claims and their equivalents.

What is claimed is:

1. A thermal printer comprising:

a support body;

a head frame supported by said support body;

an elongate line thermal head for printing data on a recording medium, said elongated line thermal head being attached to said head frame and having a longitudinal axis;

a platen unit including:

a platen having a pair of axial end portions, said platen being positioned to oppose said thermal head, and said platen having a longitudinal axis substantially parallel to the longitudinal axis of the thermal head; and supporting means for supporting said platen to be movable between a contact position where said platen contacts said thermal head and a separated position where said platen is spaced apart from said thermal head;

said support means including:

a support shaft attached to said support body and extending substantially in parallel to said platen;

a pair of support members rotatably supported on the support shaft and supporting the pair of axial end portions of said platen respectively; and an intermediate shaft positioned between said platen and said support shaft, said intermediate shaft having two end portions which are rotatably supported by a respective one of said pair of support members; and pressing means, including biasing means for biasing said supporting means toward said thermal head, for pressing said platen onto said thermal head and for applying a predetermined printing pressure to said thermal head.

2. A printer according to claim 1, wherein said biasing means includes a spring having a force-exerting end mounted to engage said intermediate shaft, for applying a biasing force to said pair of support members through said intermediate shaft.

3. A printer according to claim 2, wherein:

said intermediate shaft has a middle portion;

said spring is attached to said support shaft; and said force-exerting end of said spring is connected to said middle portion of said intermediate shaft.

4. A printer according to claim 1, wherein:

said head frame is supported by said support body to be movable between an operating position where said thermal head contacts said platen and a non-operating position where said thermal head is spaced apart from said platen; and said head frame is positioned above the platen unit.

5. A printer according to claim 4, further comprising holding means for locking said head frame in the operating position.

6. A printer according to claim 5, further comprising a ribbon supply device mounted on said head frame, for supplying an ink ribbon between said thermal head and said platen.

7. A printer according to claim 1, further comprising means for moving said platen unit at a predetermined time to move said platen from the contact position to the separated position.

8. A printer according to claim 1, wherein said head frame:

has a flat head-mounting surface positioned to oppose said platen; and attaching means for attaching said thermal head to said flat head-mounting surface so as to allow said thermal head to move slightly in a plane substantially parallel to said flat surface.

9. A printer according to claim 8, wherein said attaching means comprises:

at least one through hole formed in the head frame, said at least one through hole being open to the mounting surface;

a projection fastened to said thermal head and loosely fitted in said at least one through hole; and urging means for resiliently pressing said thermal head to the flat head-mounting surface of said head frame.

* * * * *